US009957726B2

(12) United States Patent
Milane

(10) Patent No.: US 9,957,726 B2
(45) Date of Patent: May 1, 2018

(54) DISPLACEABLE FLOOR TROWEL

(71) Applicant: Antoine Milane, Montreal (CA)

(72) Inventor: Antoine Milane, Montreal (CA)

( * ) Notice: Subject to any disclaimer, the term of this patent is extended or adjusted under 35 U.S.C. 154(b) by 406 days.

(21) Appl. No.: 14/721,081

(22) Filed: May 26, 2015

(65) Prior Publication Data

US 2016/0177580 A1 Jun. 23, 2016

(30) Foreign Application Priority Data

Dec. 17, 2014 (CA) ..... 2875259

(51) Int. Cl.

| | |
|---|---|
| ***A46B 17/02*** | (2006.01) |
| ***E04F 21/16*** | (2006.01) |
| ***B05C 17/10*** | (2006.01) |
| ***E04F 21/08*** | (2006.01) |

(52) U.S. Cl.

CPC ..... *E04F 21/162* (2013.01); *B05C 17/10* (2013.01); *E04F 21/08* (2013.01)

(58) Field of Classification Search

CPC ..... E04F 21/08; E04F 21/161; E04F 21/162
USPC ..... 401/48, 139
See application file for complete search history.

(56) References Cited

U.S. PATENT DOCUMENTS

| | | | | |
|---|---|---|---|---|
| 5,387,051 | A | 2/1995 | Valente | |
| 6,382,922 | B1 | 5/2002 | Lewis et al. | |
| 6,645,329 | B1 | 11/2003 | Rafoss | |
| 7,138,015 | B2 | 11/2006 | Rytter et al. | |
| 9,234,359 | B2 * | 1/2016 | Bourelle | E04F 21/162 |
| 2007/0266937 | A1 | 11/2007 | Fascianella et al. | |
| 2013/0000246 | A1 | 1/2013 | Bourelle | |

FOREIGN PATENT DOCUMENTS

| | | |
|---|---|---|
| EP | 2347066 | 7/2012 |

* cited by examiner

*Primary Examiner* — Jennifer C Chiang
(74) *Attorney, Agent, or Firm* — Norton Rose Fulbright Canada LLP

(57) ABSTRACT

A displaceable floor trowel for applying a flowable material to a floor surface includes a body having a back wall and two spaced apart guide walls extending forwardly from the back wall. A blade assembly for applying the flowable material includes a blade disposed behind the back wall. At least one connection member connects the blade to the body such that the blade is moveable to selectively engage the bottom application edge with the flowable material. A connection between the connection member(s) and the blade or the body is configurable in first and second alternate configurations. In the first configuration, the connection member(s) maintain the bottom application edge at a constant orientation with respect to the body. In the second configuration, the connection member(s) allow a variation of the orientation of the bottom application edge with respect to the body.

25 Claims, 11 Drawing Sheets

DISPLACEABLE FLOOR TROWEL

CROSS-REFERENCE TO RELATED APPLICATIONS

This application claims priority from Canadian application No. 2,875,259, filed on Dec. 17, 2014, the entire contents of which are incorporated by reference herein.

TECHNICAL FIELD

The application relates generally to the application of materials to surfaces and, more particularly, to a displaceable floor trowel for applying a flowable material to a floor surface.

BACKGROUND OF THE ART

Known tools for applying materials to surfaces include hand-held trowels, which can be used to smooth and distribute a material against a vertical, horizontal, or inclined surface.

When hand-held trowels are used to apply tile cement to a floor or subfloor, for example, the worker must typically be on her or his knees to first spread the cement, and then to smooth it out to receive a tile thereon. This takes a toll on the worker's knees, back, and/or body, particularly when the worker must apply the tile cement over relatively large surfaces, or for long periods of time.

Furthermore, the application of the tile cement can vary between workers. For example, each worker may not apply a uniform thickness of tile cement, especially when fatigued. This can cause the subsequent laying of tiles to be misaligned. If two or more workers are applying the tile cement to a given row, it is unlikely that they will have applied the tile cement with a uniform thickness or consistency. This can also cause misalignment when the tiles are laid down.

In addition, applying tile cement manually to a floor or subfloor is time consuming and laborious. These production lags must be considered and built into any construction schedule, thus impeding other work from being performed on the floor or floor surface and affecting costs.

SUMMARY

In one aspect, there is provided a displaceable floor trowel for applying a flowable material to a floor surface, comprising: a body for receiving the flowable material therein, the body having a back wall extending along a width of the body and two spaced apart guide walls extending forwardly from the back wall, the guide walls having lower edges abuttable against the floor surface, the back wall having a rear opening in a lower portion thereof extending along at least part of the width of the body; and a blade assembly for applying the flowable material exiting the rear opening to the floor surface upon the body being displaced thereon, the blade assembly comprising: a blade disposed behind the back wall and extending at least along a width of the rear opening, the blade having a bottom application edge; and at least one connection member connecting the blade to the body such that the blade is moveable to selectively engage the bottom application edge with the flowable material exiting the rear opening, a connection between the at least one connection member and one of the blade and the body being configurable in first and second alternate configurations, wherein: in the first configuration, the at least one connection member maintains the bottom application edge at a constant orientation with respect to the body, and in the second configuration, the at least one connection member allows a variation of the orientation of the bottom application edge with respect to the body.

In another aspect, there is provided a method for applying a flowable material to a floor surface with a displaceable floor trowel, comprising: providing the flowable material to a body of the floor trowel; displacing the body on the floor surface to guide the flowable material through an opening in a rear of the body; and engaging a bottom application edge of a blade of the floor trowel with the flowable material exiting the opening as the body is displaced, including maintaining an orientation of the bottom application edge in alignment with an adjacent reference surface and at a constant height with respect thereto, the orientation of the bottom application edge varying independently of a profile of the floor surface.

DESCRIPTION OF THE DRAWINGS

Reference is now made to the accompanying figures in which.

DETAILED DESCRIPTION

Figure 1:
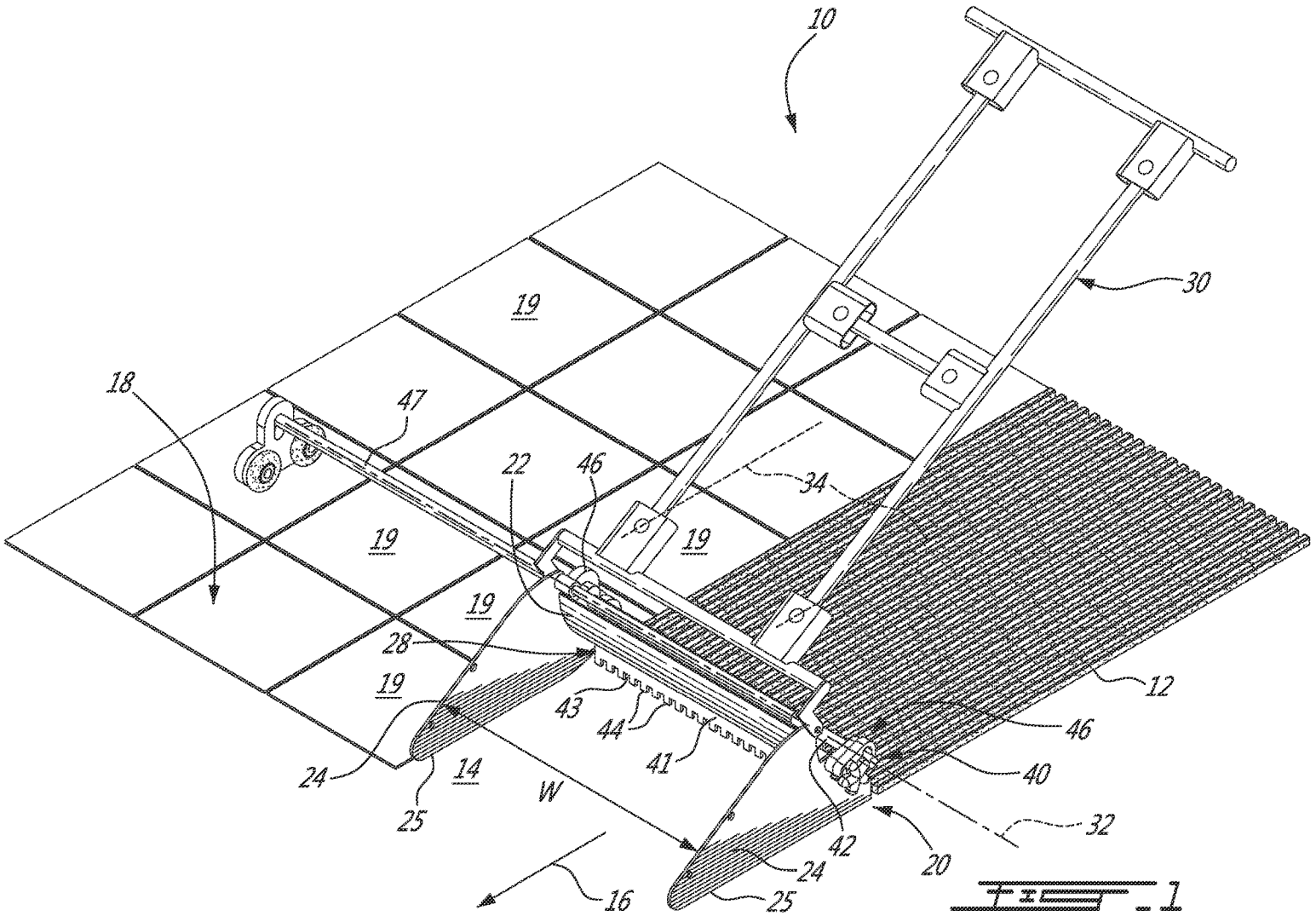
FIG. 1 is a tridimensional schematic view of a floor trowel for applying a flowable material to a floor surface, according to an embodiment of the present disclosure.

FIG. 1 illustrates a floor trowel 10 which can be displaced on a floor surface 14. The floor trowel 10 (or simply "trowel 10") is provided with a flowable material 12, which is applied to the floor surface 14 as the trowel 10 is displaced therealong. The trowel 10 therefore spreads the flowable material 12, or smooths it out, as it is displaced. Although the trowel 10 can be self-displaced with a motor or other propulsion system, in a particular embodiment it is displaced by a user of the trowel 10 who either pushes the trowel 10 from behind, or pulls the trowel 10 from the front, along a displacement direction 16.

As will be detailed further below, the trowel 10 may be used to apply a thin coat (scratch) of the flowable material over the floor surface 14 or to apply a thicker coat of the flowable material 12, for example in alignment with an adjacent application 18 of the flowable material 12, so that there is continuity between adjacent layers of the flowable material 12 and/or on material retained on top of the flowable material, e.g. rows of tiles 19, or to apply both the initial thin coat and the successive thicker coat in a same pass. For example, the trowel 10 may be used to apply the flowable material 12 such that it has the same thickness as the adjacent application 18 of the flowable material 12, such that it is level with the adjacent application 18, or both, irrespective of the profile of the floor surface 14.

The flowable material 12 can be any deformable material which a user desires to apply to the floor surface 14. This can include liquid-solid mixtures which remain permanently applied to the floor surface 14 after a drying period, such as tile cement, mortar, cementitious grout, adhesive, paint, and epoxy grout. The flowable material 12 can also be non-liquid materials, such as sand, gravel, and other solid granular materials. The floor surface 14 can be any surface forming a floor or subfloor, made of any suitable material. In some instances, the floor surface 14 can be a floor formed of tiling, such as when a user wishes to apply grout with the trowel 10.

Figure 3A:
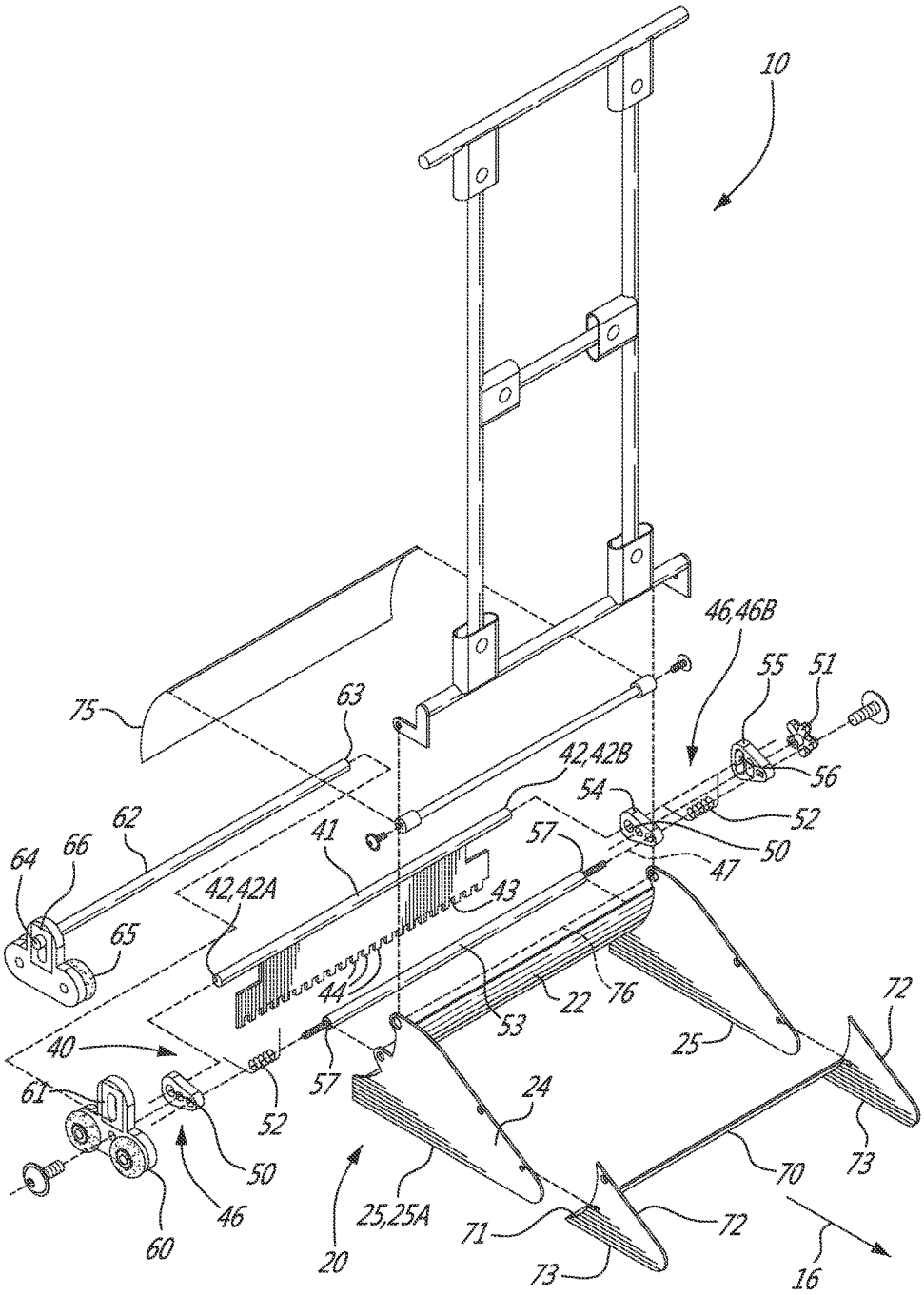
FIG. 3A is a schematic, exploded tridimensional view of the floor trowel of FIG. 1.

Referring to FIGS. 1 and 3A, the trowel 10 includes a body 20 which receives the flowable material 12 and is displaced, a handle 30 for displacing the body 20, and a blade assembly 40 for applying the flowable material 12 that exits the body 20.

Referring particularly to FIG. 1, the handle 30 is mounted to the body 20 and is manipulated by the user to displace the body 20 along the displacement direction 16. Although shown as an elongated object, the handle 30 can have different shapes and sizes which largely depend on the shape of the body 20. For example, if the body 20 is relatively tall such that the user would not need to bend to displace it, the handle 30 can be correspondingly short. In a particular embodiment, the handle 30 is adjustable in height. In the embodiment shown, the handle can pivot with respect to the body 20. The handle 30 is pivotally mounted to the body 20 using one or more appropriate hinges, such that the handle 30 pivots about a first handle axis 32 which is perpendicular to the displacement direction 16 (i.e. pivots forward and backward). The handle 30 is also pivotally mounted to the body 20 using one or more appropriate hinges, such that the handle 30 as a whole or portions of the handle 30 each pivot about a second handle axis 34 which is parallel to the displacement direction 16 (i.e. pivots laterally). The pivotal movement about the second handle axis(es) 34 can be confined to a specific angular range, and allows the user to displace the body 20 by pushing from behind the body 20 and to its side. The user is therefore able to displace the body 20 by standing to the side of the body 20, on a part of the floor surface 14 which has not yet received any flowable material 12. Alternately, the handle 30 may have only some of the relative motions described, or be attached to the body in a rigid manner. In some embodiments, the handle 30 may be omitted.

If desired, a moisture applicator, such as a bottle of water, can be mounted to the handle 30 to apply water, in vaporized or liquid form, to the flowable material 12, or to the tiles 19. The moisture so applied can help achieve the desired consistency of the flowable material 12, or can help to clean material such as a grout from the surface of the tiles 19.

In a particular embodiment, the forward and backward pivoting motion of the handle is biased upwardly, for example through a spring arrangement (not shown), such that a downward force applied by the user against the spring arrangement acts to push the body 20 against the floor surface 14 and/or toward the displacement direction. Such bias may help facilitate maintaining the body 20 in contact with the floor surface 14 during use and/or may help prevent the downward force on the handle causing forward/rearward tipping of the body 20.

Referring back to FIGS. 1 and 3A, the body 20 is the corpus of the trowel 10 and provides structure thereto. It receives therein an amount of the flowable material 12 to apply to the floor surface 14 as the body 20 is displaced along the displacement direction 16. The body 20 can therefore take different shapes and configurations, and is not limited to those shown in the figures. The body 20 includes a back wall 22 extending along the width W of the body 20, with a rear opening 28 defined therein, and spaced apart guide walls 24 which extend forwardly from the back wall 22 and abut against the floor surface 14.

The back wall 22 is the structure against which the flowable material 12 accumulates as the body 20 is moved along the displacement direction 16, irrespective of whether the body 20 is pushed or pulled. It can therefore take any shape which facilitates the task of spreading and smoothing the flowable material 12. For example, the back wall 22 can be inclined toward the displacement direction 16, or can have a curved convex surface in contact with the flowable material, as shown. Other configurations are also possible.

In the embodiment shown, the back wall 22 extends between, and connects to, the two or more guide walls 24. In the embodiment shown, the back wall 22 does not abut against the floor surface 14 as the body 20 is displaced. Instead, a lower portion of the back wall 22 includes the rear opening 28, which is an aperture that extends along some, or all, of the width W of the body 20. Generally, the rear opening 28 is adjacent to the floor surface 14, such that the lowest edge of the back wall 22 is raised from the floor surface 14 by the height of the rear opening 28. It will be appreciated, however, that the rear opening 28 can be located on another part of the lower portion of the back wall 22, such that there is a segment of the back wall 22 in contact with the floor surface 14 and below the rear opening 28. In some embodiments, the rear opening 28 can be closed off so that the body 20 accumulates the flowable material 12 therein. In most instances, when the body 20 is displaced along the displacement direction 16, the flowable material 12 is forced out through the rear opening 28 toward the rear of the body 20.

The guide walls 24 form the lateral boundaries of the body 20, thereby confining the flowable material 12 to a volume within the body 20 circumscribed by the guide walls 24 and the back wall 22. The guide walls 24 therefore help to guide the flowable material 12 towards the rear opening 28 as the body 20 is displaced. The shape of the guide walls 24 can therefore vary, provided that they form a barrier preventing the displacement of the flowable material 12 therethrough. If necessary, the body 20 can include one or more other walls (e.g. a front wall) so that the flowable material 12 is bound by a periphery defined by the walls. In the embodiment shown, the guide walls 24 are generally parallel to one another, and to the adjacent application 18 of the flowable material 12. Each of the guide walls 24 has a lower edge 25 which abuts against the floor surface 14 as the body 20 is displaced.

Figure 3B:
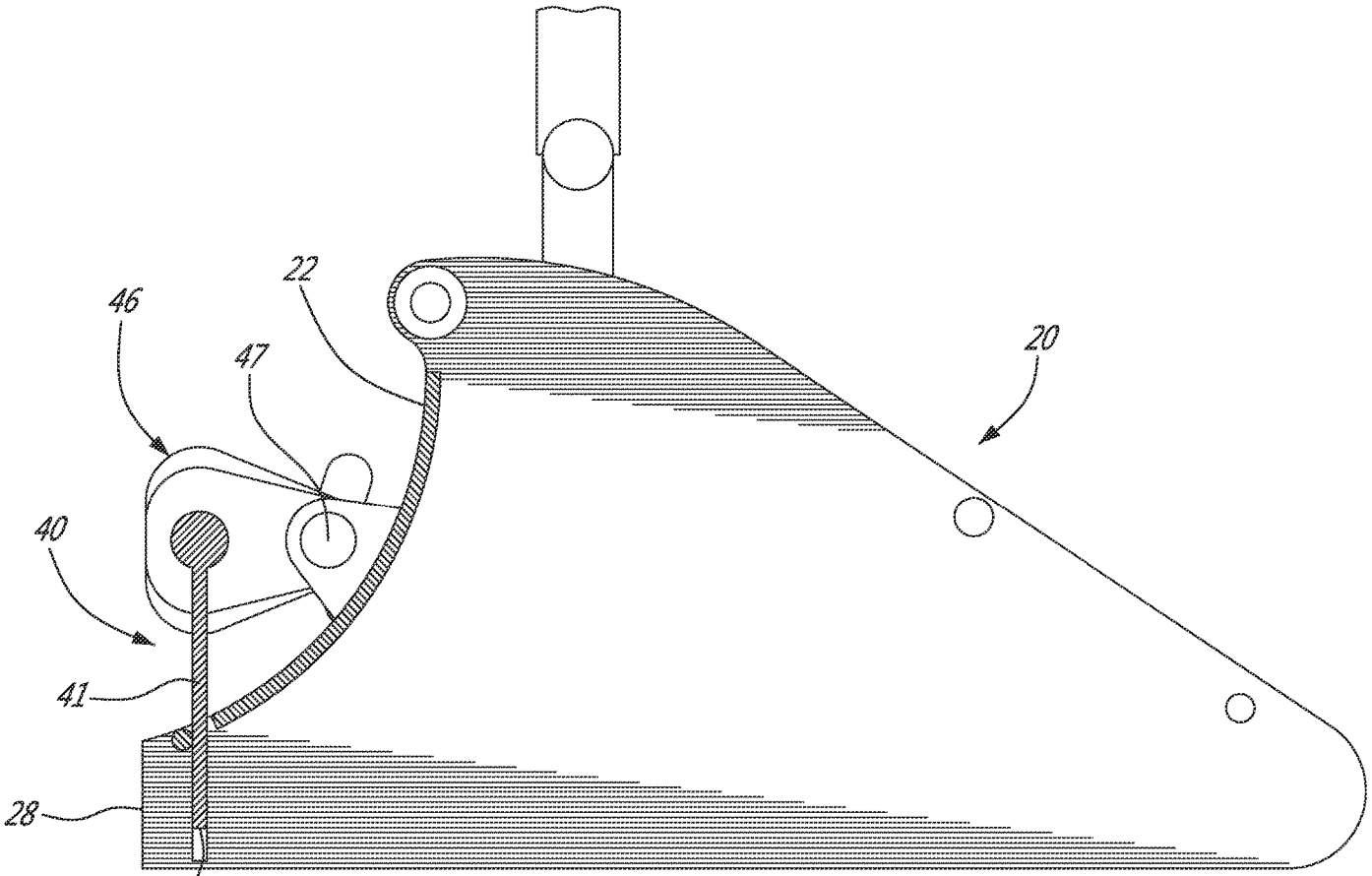
FIG. 3B is a schematic cross-sectional side view of the body of the floor trowel of FIG. 1.

Referring to FIGS. 3A-3B, the blade assembly 40 applies the flowable material 12 which exits the rear opening 28 to the floor surface 14 as the body 20 is displaced along the displacement direction 16. The blade assembly 40 therefore completes the application of the flowable material 12, and prepares it to be used (e.g. for receiving tiles thereon). The blade assembly 40 includes a blade 41 with a bottom application edge 43 which selectively engages the flowable material 12 exiting the rear opening 28, and at least one connection member movably connecting the blade 41 to the body 20. As will be further detailed below, in a particular embodiment, the connection member(s) allow for the blade and body to be interconnected in two alternate configurations: one where the bottom application edge 43 is at a constant orientation with respect to the body 20, and another where the orientation of the bottom application edge 43 is variable with respect to the body 20. In the particular embodiment shown, the connection member(s) include two pivot members 46.

The blade 41 is located rearward of, or behind, the back wall 22. The blade 41 is therefore protected by the back wall 22 from the flowable material 12 within the body 20. In its position behind the back wall 22, the blade 41 is also suitably placed so that it can be moved upwards and downwards to decrease or increase, respectively, its engagement with the flowable material 12. The movement of the blade 41 is generally a response to the pivotal movement of the pivot members 46, toward and away from the floor surface 14. In the embodiment shown, the blade 41 includes a planar piece of sheet metal or plastic which extends along some or all of the width W of the body 20. The blade 41 has two opposed ends 42, each one being located at, or in proximity to, one of the guide walls 24. In the embodiment shown, the ends 42 are defined by ends of a support shaft extending across the blade sheet. Alternately, the ends 42 may be formed as parts of the blade sheet.

The blade 41 has an application edge 43 located on the bottom of the blade 41 and extending at least along the width of the rear opening 28. The application edge 43 engages the flowable material 12 and spreads, smooths, thins, diverts, or forms it as required. As the blade 41 is moved by the pivot members 46, the application edge 43 selectively engages the flowable material 12 coming from the rear opening 28. The expression "selectively engage" refers to the ability of the application edge 43 to enter into contact with the flowable material 12, and to vary the amount of contact, as the blade 41 is moved, in order to apply the flowable material 12 to the floor surface 14. The application of the flowable material 12 by the application edge 43 can vary, depending on the flowable material 12 being applied, and the floor surface 14 to which it is applied. For example, the application edge 43 can have a plurality of teeth 44 (as shown) which applies a grooved-pattern to the flowable material 12 as it passes through the application edge 43. Such an application of the flowable material 12 is suitable for applying tile cement prior to laying tiles 19 thereon. The depth and width of the teeth 44 can be varied as needed by changing the application edge 43 and/or blade 41.

The pivot members 46 of the blade assembly 40 are pivotally connected to the body 20. In the embodiment shown, the pivot members 46 are located on either end 42 of the blade 41; alternate configurations may be possible. Each of the pivot members 46 pivots with respect to the body 20 about a pivot axis 47 which is common to the pivot members 46, and which generally extends along the width W of the body 20. In the embodiment shown, the common pivot axis 47 is defined by a common pivot shaft 53. Each of the pivot members 46 is connected, directly or indirectly, to the blade 41, for example at a respective end 42. As the pivot members 46 pivot about the pivot axis 47, they move the blade 41 and the application edge 43 up and down and thus change the engagement of the application edge 43 with the flowable material 12 according to the following two configurations.

In the first configuration, the first and second pivot members 46 are both connected to the blade 41 such that the point of connection between each pivot member 46 and the blade 41 is maintained at a constant position, for example through a rigid connection, or through a pivotal connection allowing rotation of the blade about the point of connection (as shown), for example to maintain a vertical or substantially vertical orientation of the blade as it pivots about the common pivot axis 47. As the point of connection between each pivot member 46 and the blade 41 is maintained at a constant position, the orientation of the bottom application edge 43 is maintained at a constant orientation with respect to the common pivot axis 47, or with respect to the body 20. The variations in the orientation of the bottom application edge 43 thus follow the variations in orientations of the body 20, the orientation of the body 20 being determined by the profile of the floor surface 14 it is displaced on. In other words, the orientation of the bottom application edge 43 follows the width-wise orientation of the floor surface 14.

Figure 2A:
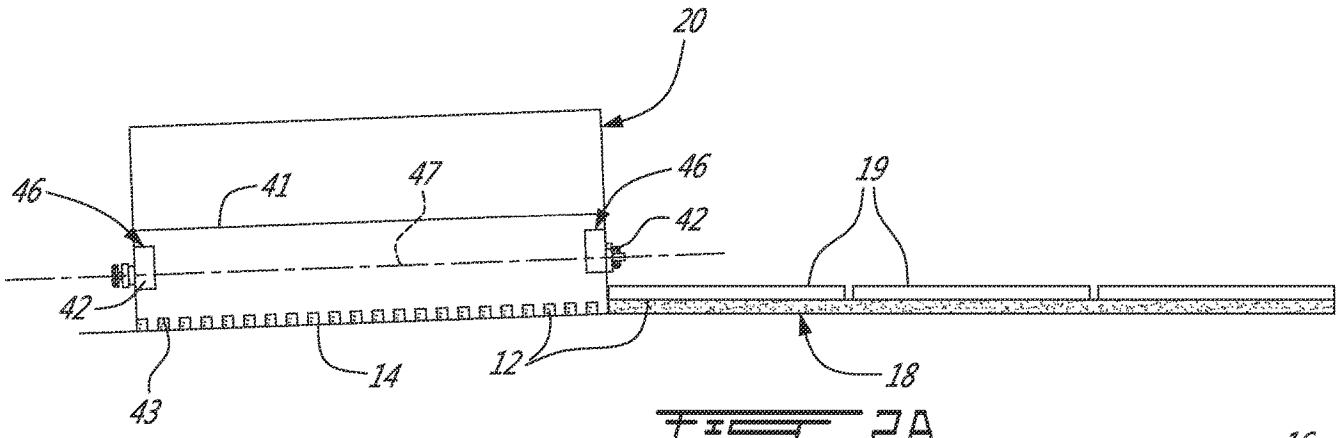
FIG. 2A is a schematic rear view of the floor trowel of FIG. 1, in use in accordance with a particular embodiment.
Figure 2B:
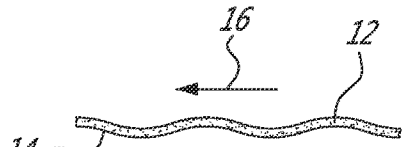
FIG. 2B is a schematic side view of an exemplary cement application performed with the floor trowel of FIG. 2A.

FIG. 2A illustrates schematically a mode of application using the first configuration. In this instance, the first and second pivot members 46 are both rigidly or pivotally connected to the blade 41 such that the bottom application edge 43 extends parallel or substantially parallel to the common pivot axis 47. The bottom application edge 43 is pressed into contact with the floor surface 14 by gravity and/or a biasing mechanism (not shown). The trowel 10 applies a thin layer of the flowable material (scratch layer) following the general profile of the floor surface 14; as illustrated in FIG. 2B, if the floor surface 14 has height variations along the displacement direction 16 of the body 20, the flowable material is applied following the height variations to the extent that they can be accommodated by the rigid body 20. However, if the body 20 encounters a sudden hole or divot in the floor surface 14, or a hole smaller than the body 20 and located between the guide walls 24, the flowable material 12 fills the hole to the level defined by the portions of the floor surface 14 engaging the guide walls. The flowable material may thus define a smoother surface than that of the floor surface 14. Absent such holes or sudden variations, the flowable material can be said to be applied with a constant or substantially constant thickness across the width of the body 20 and along the displacement direction 16.

Figure 2C:
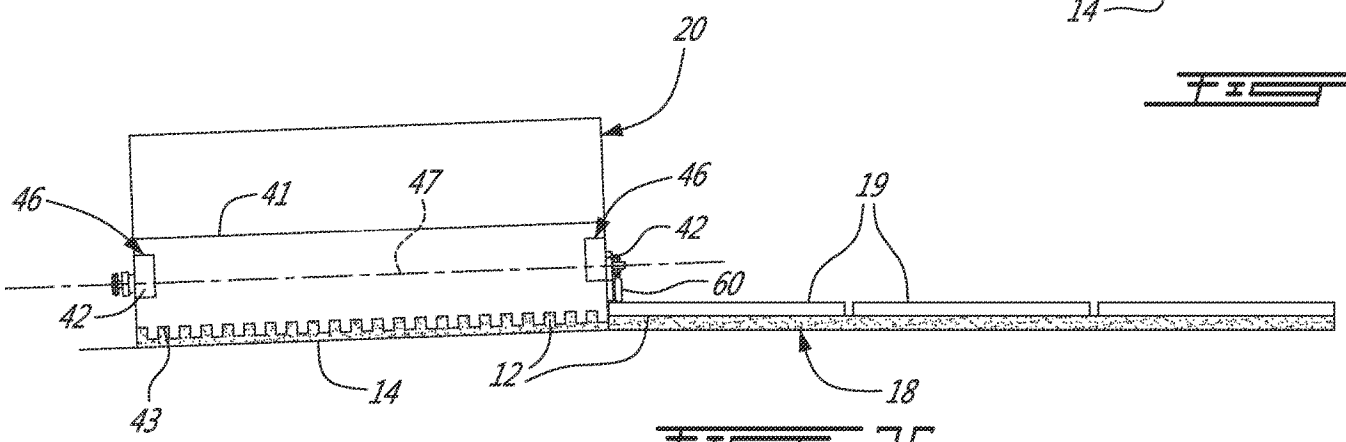
FIG. 2C is a schematic rear view of the floor trowel of FIG. 1, in use in accordance with another particular embodiment.
Figure 2D:
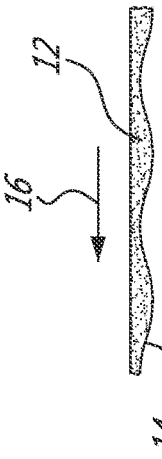
FIG. 2D is a schematic side view of an exemplary cement application performed with the floor trowel of FIG. 2C.

FIG. 2C illustrates schematically another mode of application using the first configuration. Like in FIG. 2A, the first and second pivot members 46 are both rigidly or pivotally connected to the blade 41 such that the bottom application edge 43 extends parallel or substantially parallel to the common pivot axis 47. The orientation of the bottom application edge 43 thus still follows that of the floor surface 14. In this embodiment, a guide roller 60 has a wheel support rigidly connected, directly or via another component, to the end 42 of the blade 41 near the adjacent row of tiles 19, and is positioned to roll on the tiles 19. The height of the blade 41 is thus determined by the engagement between the guide roller 60 and adjacent tiles 19. As illustrated in FIG. 2D, the height variations (or lack thereof) of the flowable material along the displacement direction 16 are independent of height variations in the floor surface 14 along the displacement direction 16 of the body 20, but are determined by the height variations (or lack thereof) of the adjacent row of tiles 19. Absent holes or sudden variations (which become filled with the flowable material), the flowable material is applied with a constant or substantially constant thickness across the width of the body 20.

The flowable material 12 can thus be applied in a layer having the same height as the flowable material 12 of the adjacent application 18 supporting the tiles 19 along the displacement direction 16, but following the width-wise orientation or slope of the floor surface 14, regardless of the width-wise orientation or slope of the adjacent row of tiles 19. The tiles to be laid on the new layer of flowable material 12 can thus have an adjacent edge at the same height as the adjacent row of tiles 19 and accordingly a similar slope along the displacement direction 16 to form a continuous floor, but may define a different width-wise slope than the adjacent row of tiles 19 such that the continuous floor includes slope variations.

The guide roller 60 may be replaced by any other structure engageable with the adjacent tiles 19. The guide roller 60 may include a height adjustment mechanism 61 to adjust a height of the blade 41 with respect to the adjacent tiles 19, to select a thickness of flowable material to be applied.

Figure 2E:
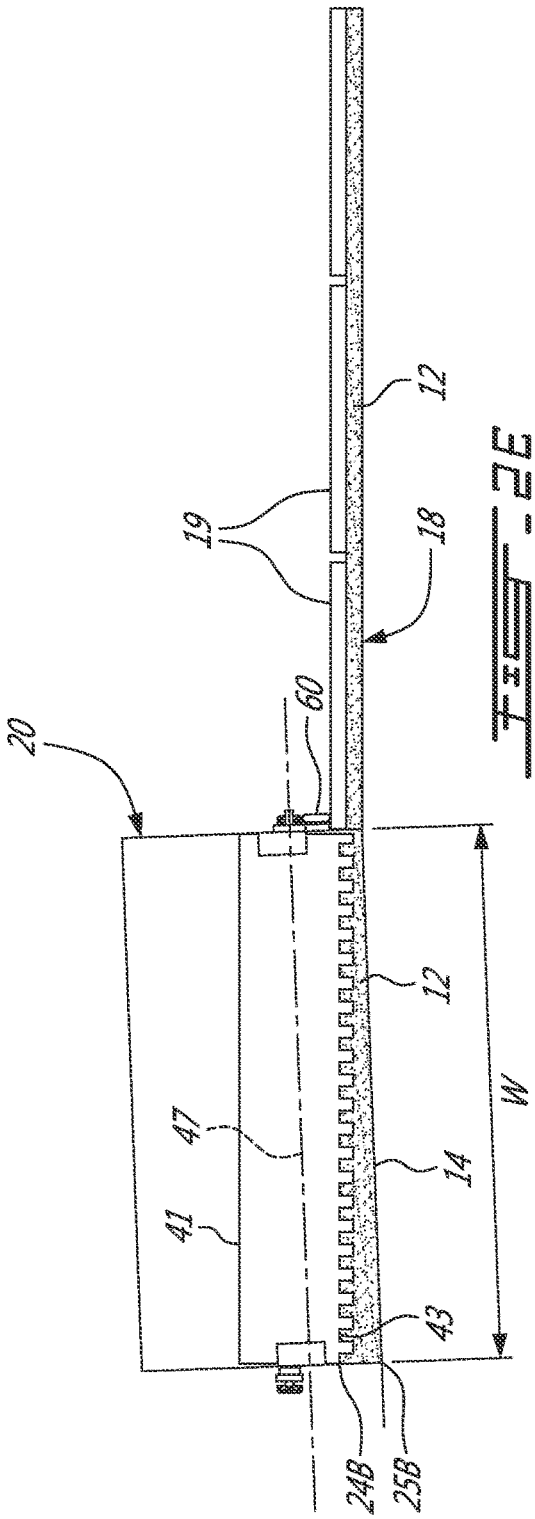
FIG. 2E is a schematic rear view of the floor trowel of FIG. 1, in use in accordance with another particular embodiment.

FIG. 2E illustrates schematically another mode of application using the first configuration. Like in FIG. 2C, the first and second pivot members 46 are both rigidly or pivotally connected to the blade 41 such that the bottom application edge 43 has a constant orientation with respect to the common pivot axis 47, and the guide roller 60 is positioned to roll on the tiles 19. However in this case, the bottom application edge 43 is not parallel with the common pivot axis 47 and accordingly, not parallel with the floor surface. The height variations of the flowable material along the displacement direction 16 is independent of height variations in the floor surface 14 along the displacement direction 16, and determined by the height variations of the adjacent row of tiles 19. Absent holes or sudden variations (which become filled with the flowable material), the flowable material is applied following the angled thickness profile across the width of the body 20 which is determined by the angle of the bottom application edge 43 with respect to the common pivot axis 47.

The flowable material 12 can thus be applied in a layer having the same height as the flowable material 12 of the adjacent application 18 supporting the tiles 19 along the displacement direction 16 at the junction with the adjacent application 18, at a constant angle with respect to the width-wise orientation or slope of the floor surface 14, regardless of the width-wise orientation or slope of the adjacent row of tiles 19. In the embodiment shown, the angle of the bottom application edge 43 is selected such that the tiles to be laid on the new layer of flowable material 12 have a similar width-wise slope as that of the adjacent row of tiles 19, but alternate configurations may also be obtained through different angles of the bottom application edge 43.

It is understood that the modes of applications shown for the first configuration are examples only and that the first application can be used with alternate modes of applications.

In the second configuration, the pivot member 46B furthest from the adjacent row of tiles 19 is rigidly or pivotally connected to the blade 41, and the pivot member 46A closest to the adjacent row of tiles 19 is slidingly connected to the blade 41 through a connection defining a relative sliding motion along a limited path. As the point of connection between the pivot member 46A with the sliding connection and the blade 41 is variable, the orientation of the bottom application edge 43 can vary with respect to the common pivot axis 47, or with respect to the body 20. The variations in the orientation of the bottom application edge 43 thus become independent from the variations in orientations of the body 20. In other words, the orientation of the bottom application edge 43 is independent of the width-wise slope of the floor surface 14.

Figure 2F:
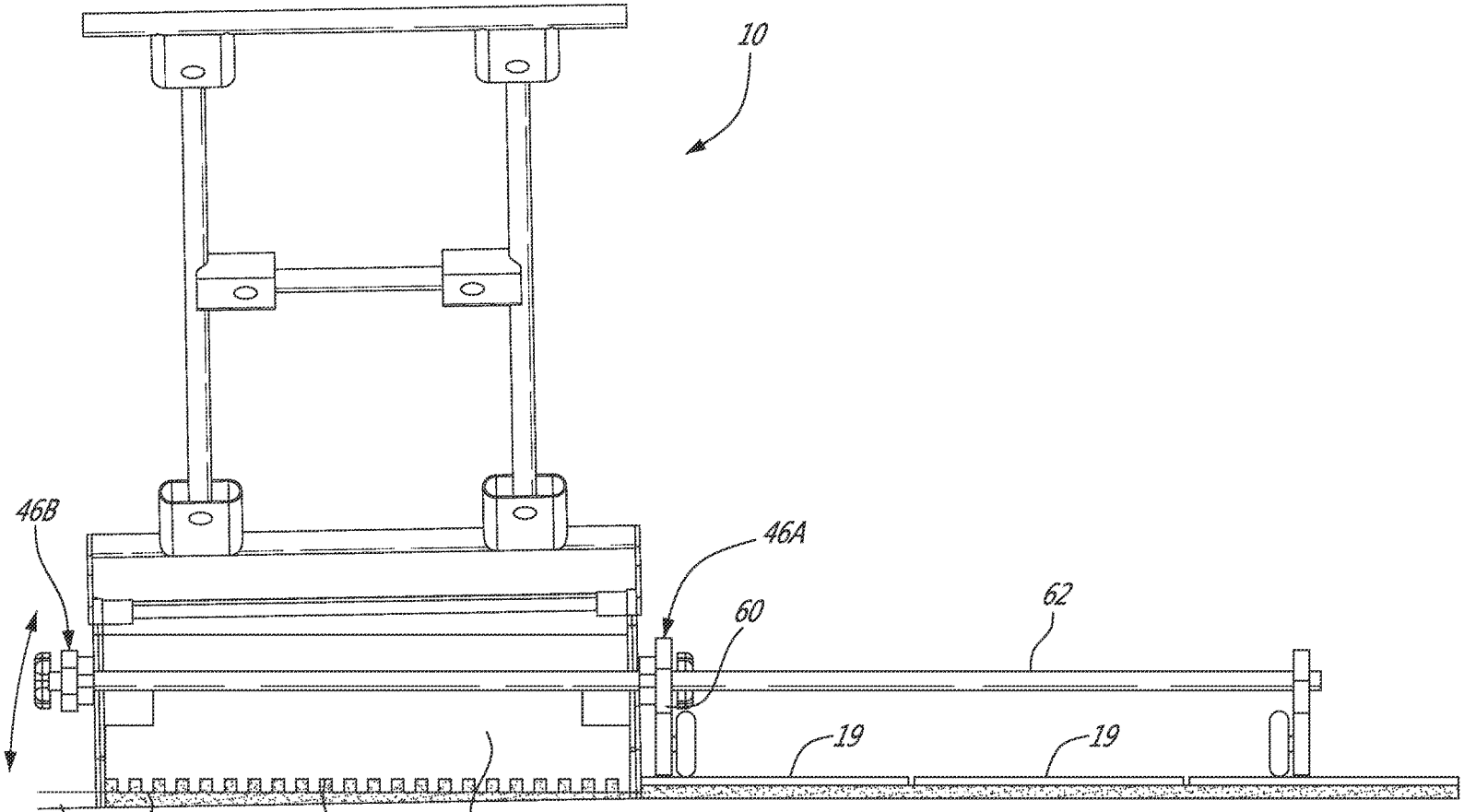
FIG. 2F is a schematic rear view of the floor trowel of FIG. 1, in use in accordance with another particular embodiment and in combination with a levelling bar.

FIG. 2F illustrates schematically a mode of application using the second configuration. The height of the blade 41 is determined by the engagement between the guide roller 60 and adjacent tiles 19. The trowel 10 includes an elongated levelling bar 62 extending laterally from the body 20, and having a first bar end 63 and an opposed second bar end 64. The first bar end 63 is rigidly connected to the wheel support of the guide roller 60 or to the end 42 of the blade 41 connected to the guide roller 60, with the wheel support of the guide roller 60 being rigidly connected to the blade 41. The levelling bar 62 includes a wheeled support 65 mounted thereon at a distance from the first bar end 63 to cooperate with the guide roller 60 to displace the levelling bar 62 along and parallel to the surface of the adjacent row of tiles 19. The interconnected levelling bar 62, guide roller 60 and blade 41 pivot together about the pivot axis 47 through the pivot member 46A which is rigidly or pivotally engaged to the blade 41, independently of the movement of the pivot member 46B which is slidingly engaged to the blade 41. The relative height of the two guide walls 24 thus do not affect the orientation of the bottom application edge 43, which follows the width-wise slope of the adjacent row of tiles 19 through the engagement of the levelling bar 62 and guide roller 60 therewith.

The height variations of the flowable material along the displacement direction 16 follows the height variations of the adjacent row of tiles 19, and the variations of the orientation of the bottom application edge 43 follow the width-wise orientation or slope of the adjacent row of tiles 19. The surface profile of the applied flowable material is thus independent from that of the floor surface 14. The flowable material may therefore have a non-uniform thickness across the width W of the body 20 and/or the displacement direction 16.

Like the guide roller 60, the wheeled support 65 may have a height adjustment mechanism 66 which allows the user to adjust a height of the levelling bar 62 (and thus the blade 41 connected thereto) with respect to the adjacent tile surface.

It is understood that the modes of application shown for the second configuration is an example only and that the second application can be used with alternate modes of applications.

In can thus be appreciated that the trowel 10 allows the user to apply the flowable material 12 to the floor surface 14 such that it has a constant thickness across the width W of the body 20, following the width-wise slope of the floor surface 14 or adjacent row of tiles 19, and/or following the slope along the displacement direction of the floor surface 14 or adjacent row of tiles 19, as required for a particular application.

Referring now to FIGS. 3A-3B, in a particular embodiment the pivot members 46 are pivotally connected to the body 20 through a pivot connection with the back wall 22 of the body 20, so that they can pivot with respect to the back wall 22 about the pivot axis 47. In a particular embodiment, the placement of the pivot members 46 toward the rear of the body 20, particularly when the rear surface of the back wall 22 has a curved profile, protects the blade assembly 40 from the flowable material. It may also allow the rear of the trowel 10 to be more closely spaced from a wall in a room so that it can begin applying the flowable material more closely to that wall.

Referring to FIG. 3A, in the embodiment shown, the pivot shaft 53 defines the pivot axis 47 of the pivot members 46 is pivotally engaged to the back wall 22. The shaft 53 has opposed pivot shaft ends 57 each mounted to a corresponding pivot member 46. The pivot member 46B selectively configurable to be slidingly engaged with the blade 41 include a first bracket 54 mounted to one of the pivot shaft ends 57 and having a hole 50, and a second bracket 55 having a blade slot 56 defined therein, the hole 50 and slot 56 receiving a pin forming part of the end of the blade 41. The first bracket 54 is non-slidingly (e.g. rigidly or pivotally) engaged to the blade 41. This pivot member 46B is slidingly connected to the blade 41 in the second configuration through the engagement of the pin end 42B of the blade 41 in the blade slot 56 of the second bracket 55, and the first bracket 54 moves with the blade 41 relative to the second bracket 55. In the first configuration, a tightening mechanism 51 selectively connect the two brackets 54, 55 together to prevent the sliding movement of the pin end 42B within the slot 56, the pin end 42B being prevented from sliding through its engagement with the first bracket 54. In the second configuration, the tightening mechanism 51 is loosened so as to allow the relative movement between the brackets 54, 55 and accordingly, sliding of the pin end 42B within the slot 56. The tightening mechanism 51 can be, for example, a knob, screw, or other element which can selectively prevent or allow the relative sliding movement of the blade end 42B within the slot 56.

In a particular embodiment both pivot members 46 are configurable such as to be selected between a constant location (rigid or pivot) connection or a sliding connection with the blade 41, such as to allow use of the second configuration with an adjacent row of tiles 19 on any side of the body.

In order to help maintain a position of the application edge 43 adjacent to the floor surface, one or more of the pivot members 46 can have a biasing element 52. The biasing element 52 engages the blade 41 so as to bias the application edge 43 towards the floor surface. In the particular embodiment show, the biasing element(s) 52 includes a rotational spring engaged to the two brackets 54, 55. In other embodiments, the biasing element(s) 52 can apply an upward force to bias the application edge 43 or some other component away from the floor surface.

Although the connection member(s) having the two alternate configurations have been described as pivot members, it is understood that other types of connection member(s) can be used. For example, the blade may be connected to one or more connection members through a scissors-type attachment to allow movement of the blade with respect to the connection member(s) along the width of the blade, and the connection member(s) may be engaged to the body in the two alternate configurations, i.e. defining at the side of the blade opposed to the adjacent row of tiles a connection alternately configurable between a constant location (rigid or pivot) connection or a slidable connection. Other types of connection members are also possible.

It may sometimes be desirable to apply a first layer of the flowable material to prime or prepare the floor surface before applying the flowable material with the blade 41. In the embodiment shown, and still referring to FIG. 3A, the trowel 10 has a second blade 70. The second blade 70 spans the width of the body 20, and is mounted to the guide walls 24 to be positioned in front of the back wall 22. In a particular embodiment, the second blade 70 is pivotally mounted to the guide walls 24 so that it can be pivoted away from the floor surface when its presence is no longer required. The second blade 70 has a bottom blade edge 71 which is generally located in close proximity to the floor surface so that it can apply the "scratch", or first, layer of the flowable material. The bottom blade edge 71 can therefore have a plurality of teeth therein to apply a grooved primer layer, or an applicator to apply a thin primer layer.

The second blade 70 applies a primer layer of the flowable material before the blade 41 applies the generally thicker layer of flowable material. As such, the second blade 70 can take many different shapes and forms, such as being inclined towards the displacement direction 16. The second blade 70 may also be curved, such that a convex side of the second blade 70 faces the floor surface when the bottom blade edge 71 is adjacent to the floor surface. The convexly curved second blade 70 can help to better distribute and apply the flowable material.

In the embodiment shown, the second blade 70 is a component of a second, forward floor trowel. More particularly, two extension walls 72 are each mounted to a front end of one of the guide walls 24. Each extension wall 72 extends forward from the guide walls 24 along the displacement direction 16. Similarly to the guide walls 24, each extension wall 72 helps to confine the flowable material within the body 20. Also similarly to the guide walls 24, each extension wall 72 has a bottom extension edge 73 which abuts against the floor surface when being used. The second blade 70 extends between and connects the extension walls 72. In a particular embodiment, the second blade 71 is integral with the extension walls 72, and the second blade 70 and extension walls 72 can all be pivoted away from the floor surface when not required.

Depending on the flowable material being used, it may be desired to provide additional protection to the blade assembly 40. In the embodiment shown, an optional deflector shield 75 is provided, removably and pivotally mounted to a top portion of the guide walls 24 and/or back wall 22. The deflector shield 75 pivots with respect to the body 20 about a shield axis 76 which is perpendicular to the displacement direction 16. The deflector shield 75 has a curvature such that when it is pivoted backwards, it encases the blade assembly 40 disposed against the back wall 22, thereby protecting it from the flowable material.

Figure 4A:
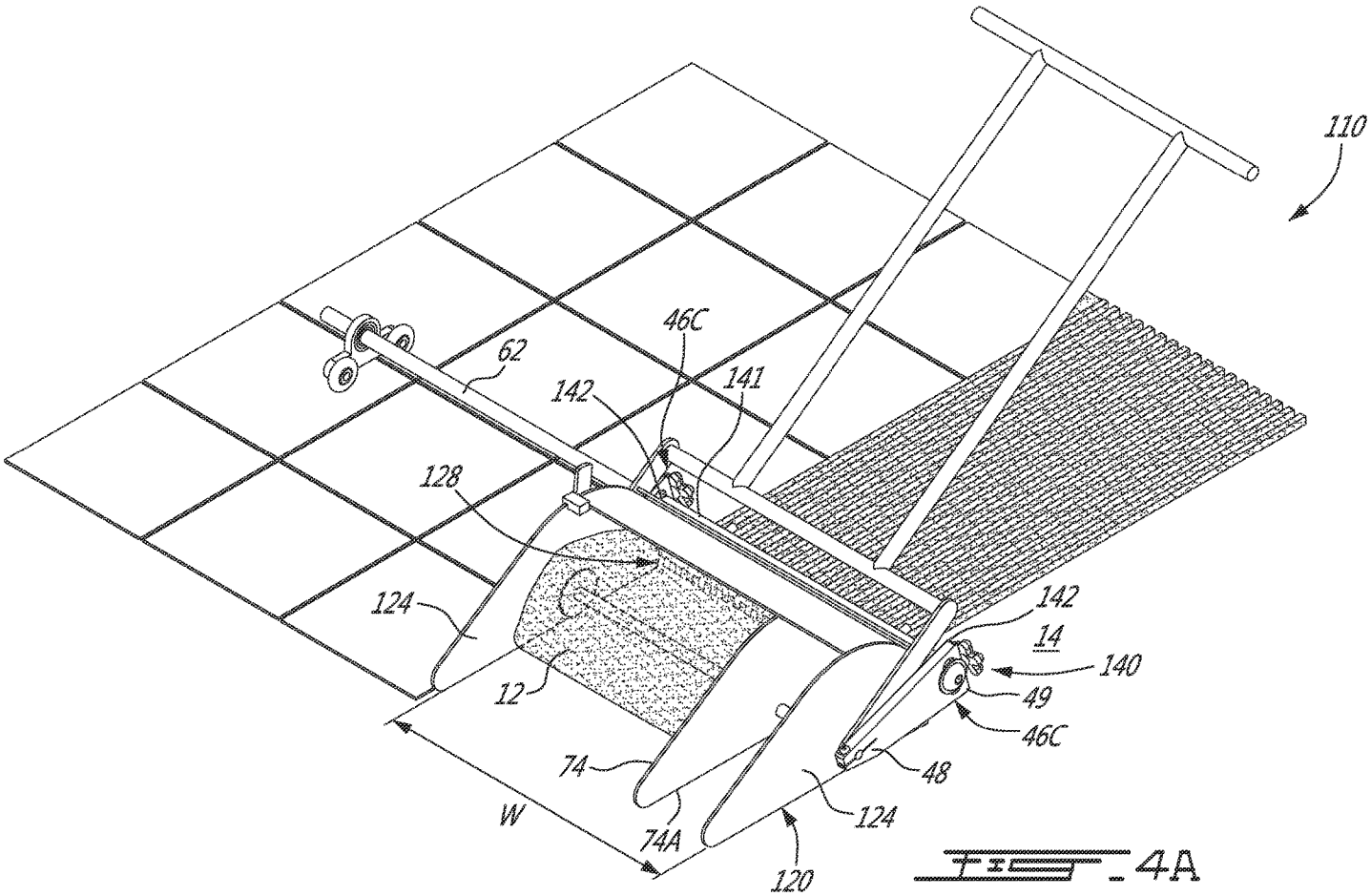
FIG. 4A is a schematic tridimensional view of a floor trowel for applying a flowable material to a floor surface, according to another embodiment of the present disclosure.
Figure 4B:
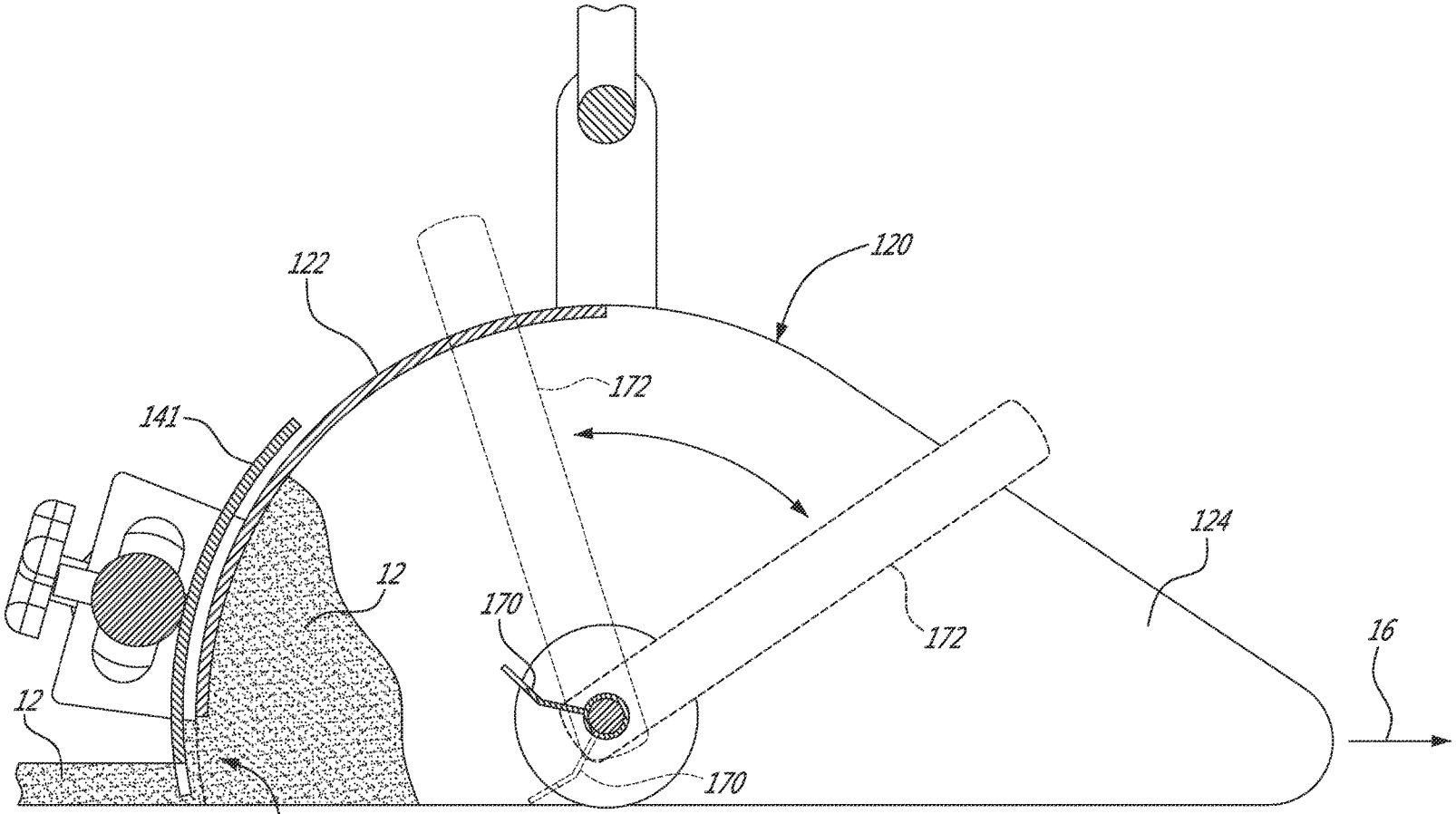
FIG. 4B is a schematic cross-sectional side view of a body of the floor trowel of FIG. 4A.

Referring now to FIGS. 4A-4B, a trowel 110 according to an alternate embodiment is shown. The back wall 122 has curved concave surface is contact with the flowable material, and defines the rear opening 128. The blade 141 of the blade assembly 140 is curved and engages the flowable material 12, such that it passes through or under the blade 141 and is applied to the floor surface 14. The second blade 170 is mounted to a shaft extending within the body 120 across its width and pivotally connected to the guide walls 124. Handles 172 (FIG. 4B) are connected to the shaft and allow to pivot the second blade 170 to engage or disengage the flowable material 12.

Each of the pivot members 46C extends between a first end 48 which is pivotally connected to the body 120 through a pivot connection with a respective one of the guide walls 124. A second end 49 of each pivot member 46C extends behind the back wall 22, and is connected to the ends 142 of the blade 141, thereby positioning the blade assembly 40 behind the back wall 22. The pivot members 46C may be selectively connected to the blade 41 in either constant location (rigid or pivoting) manner, or a slidable manner, as previously described.

The trowel 110 includes an optional intermediate guide wall 74. The intermediate guide wall 74 allows the user to adjust the width W of the interior of the body 120, and therefore adjust the width of the layer of the flowable material 12 applied to the floor surface 14. The intermediate guide wall 74 is similar to each of the guide walls 124 in that it prevents the displacement of the flowable material 12 therethrough, and guides the flowable material towards the rear opening 28. The intermediate guide wall 74 can be mounted to, and removed from, the body (for example the back wall) between the guide walls 124 and parallel to at least one of them. The intermediate guide wall 74 has a bottom intermediate edge 74A which abuts against the floor surface 14.

It is understood that the intermediate guide wall 74 may be provided with other embodiments of the trowel, such as the trowel 10 described above. Other techniques for adjusting the width W of the body 20, 120 are also within the scope of the present disclosure. For example, some or all of the components of the trowel 10, 110 can be extended and contracted along a direction which is parallel to the width W. One of the guide walls 24, 124 may be connected to an extendable shaft which is configured to be displaced away from, and towards, the other guide wall 24,124 and the back wall 22, 122 may be made of two or more sections slidable with respect to one another along the width W.

Figure 5A:
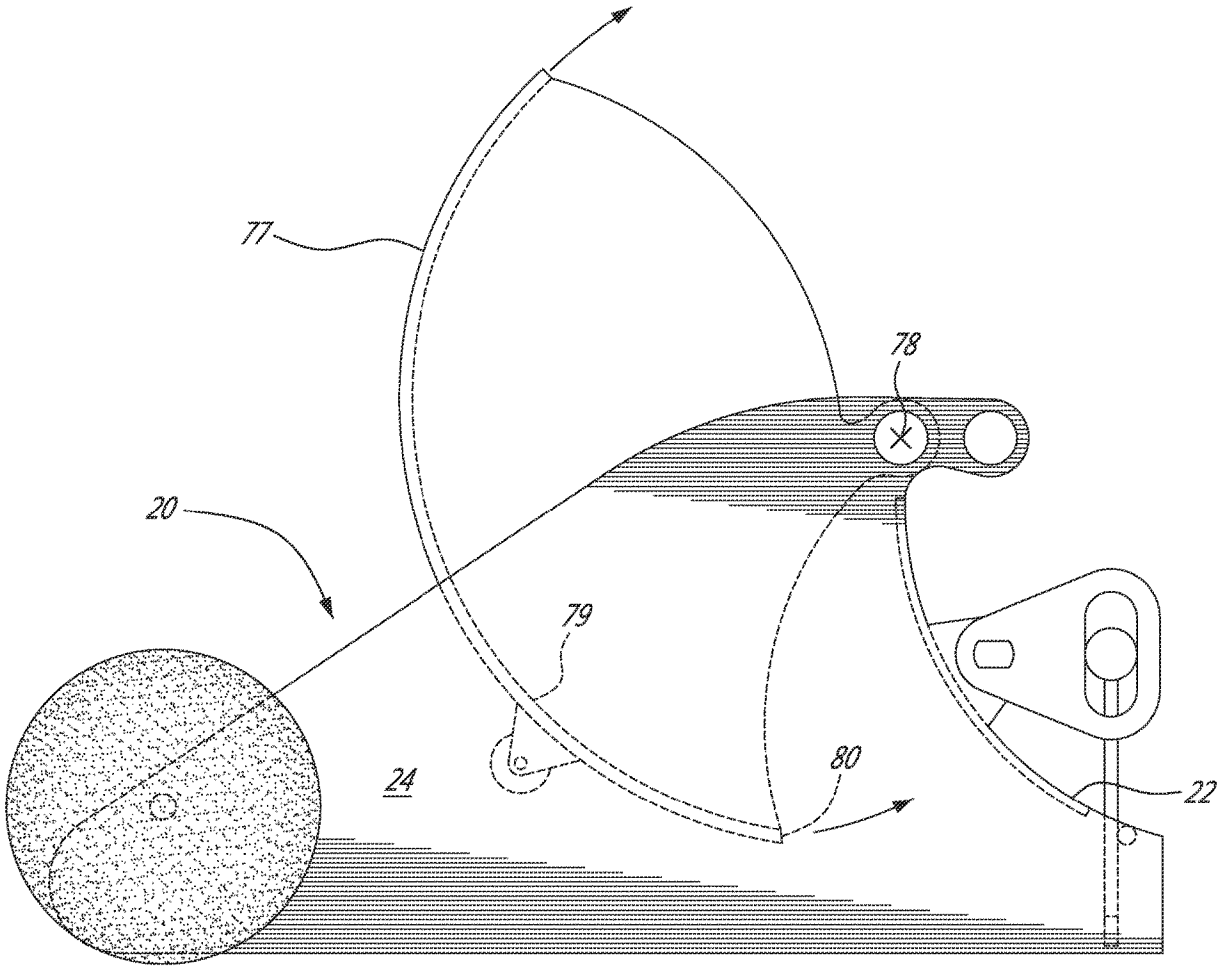
FIG. 5A is a schematic side view of a body of a floor trowel according to yet another embodiment of the present disclosure, the floor trowel having a reservoir portion shown in a partially opened position.
Figure 5B:
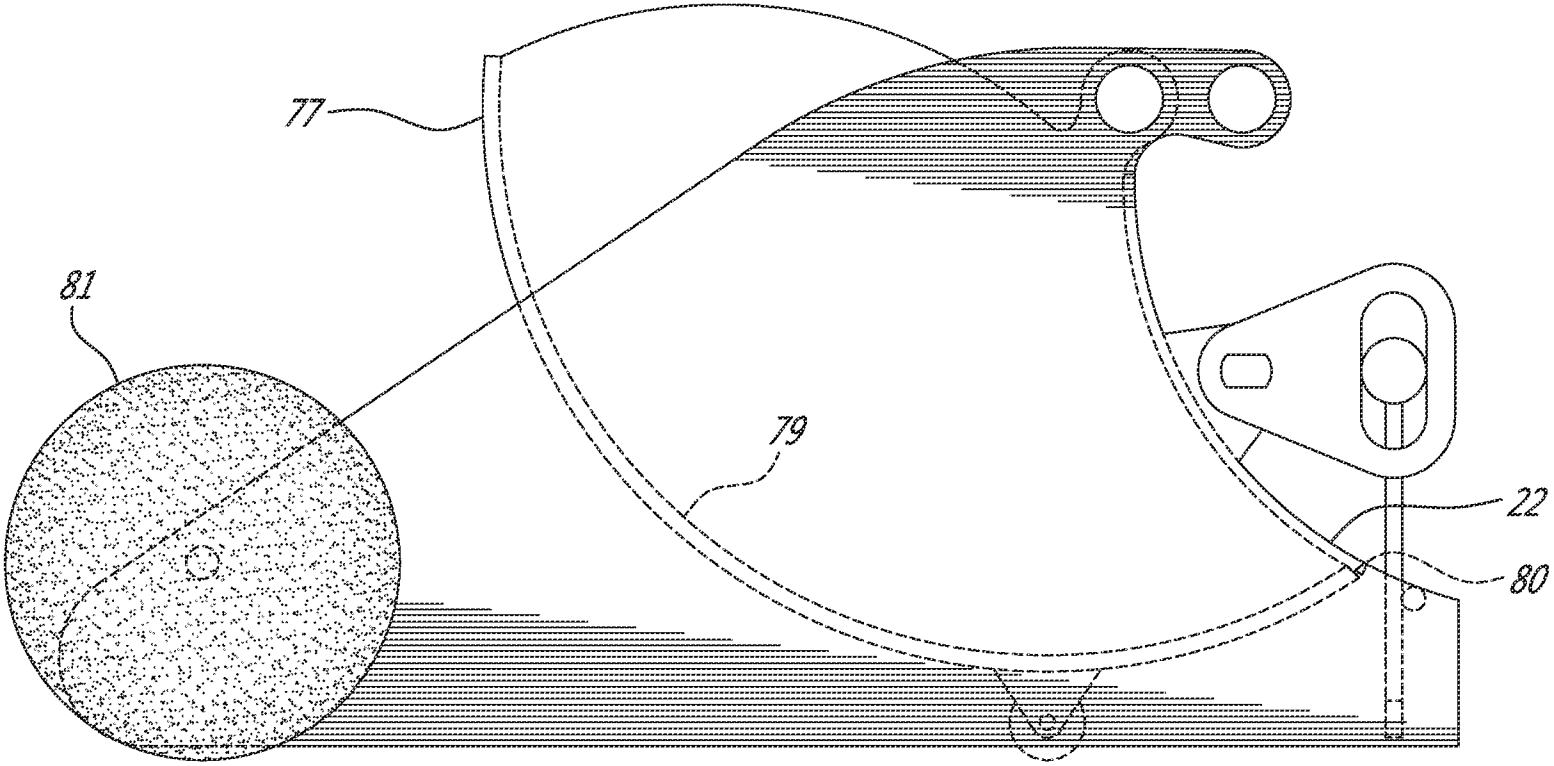
FIG. 5B is another schematic side view of the floor trowel of FIG. 5A, the reservoir portion shown in a closed position.

Referring now to FIGS. 5A and 5B, in a particular embodiment, the trowel has a reservoir portion 77 which can receive and contain the flowable material to be applied when the trowel is not being used. The user can therefore take the trowel after applying one row of the flowable material, and move it to another location to apply another row. The reservoir portion 77 defines a receiving surface 79 against which the flowable material is received. The receiving surface 79 extends along the width of the body 20 so as to form an area for receiving the flowable material. The reservoir portion 77 is pivotally mounted to the body 20 about a reservoir axis 78, for example extending between a top of the guide walls 24. The reservoir portion 77 and its receiving surface 79 can therefore pivot about the body 20 between an opened position and a closed position. The reservoir portion 77 is shown in a partially opened position in FIG. 5A, where a rear edge 80 of the receiving surface 79 is pivoted away from the back wall 22 to allow the flowable material to flow to the floor surface. FIG. 5B shows the closed position, where the rear edge 80 of the receiving surface 79 abuts the back wall 22. The cooperation of the rear edge 80 and the back wall 22 defines a receptacle to receive the flowable material. In a particular embodiment, the weight of the flowable material on the receiving surface 79 is enough to prevent the reservoir portion 77 from pivoting from the closed position to the opened position. When transitioning from the opened position to the closed position, the reservoir portion 77 can act as a scoop as the rear edge 80 is rotated towards the back wall 22. To facilitate such functionality, the receiving surface 79 can be curved concavely, for example generally matching the cross-sectional profile of the back wall 22.

The reservoir portion 77 may include a mechanism to maintain it in the open position, such as retractable side pins abutting a top surface of the guide walls 24. In a particular embodiment, the rear edge 80 of the receiving surface 79 may define the second blade 70.

FIGS. 5A and 5B also show optional wheels 81 engaged to the guide walls, which can allow the user to roll the filled trowel and reservoir portion 77 to another location; such wheels may be particularly useful when the reservoir portion 77 is filled with relatively heavy flowable material. The wheels 81 may be swivelling wheels. Additional wheels may also be provided.

Figure 6:
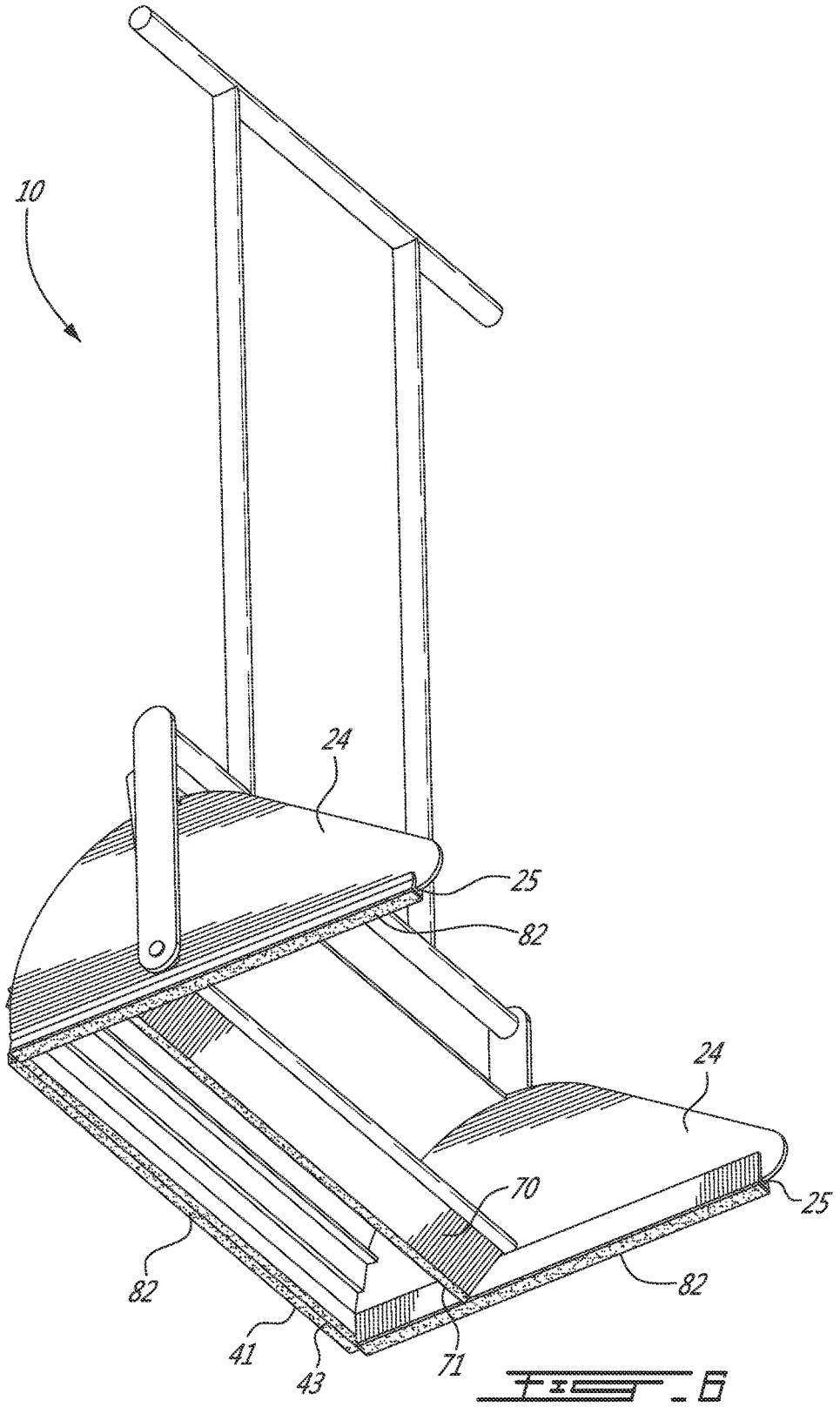
FIG. 6 is a schematic bottom tridimensional view of a floor trowel having non-metallic coverings on its lower edges, according to yet another embodiment of the present disclosure.

Referring now to FIG. 6, in a particular embodiment, the trowel 10 may be used to apply the flowable material to a floor surface that is sensitive to abrasion, for example to apply cementitious grout or epoxy grout to the joints between tiles through displacement over the tiles. The lower edges 25 of the guide walls 24 each receive a non-metallic (e.g. plastic, rubber, etc.) covering 82 extending therealong and abuttable against the floor surface; in a particular embodiment, the non-metallic covering 82 is removable. The non-metallic covering 82 on one or more of the lower edges 25 protects the floor surface from being nicked or scratched when the trowel 10 is displaced. The application edges 43, 71 of the blades 41, 70 may also include a similar covering 82 or a covering of a different material suitable for the application of the flowable material to define suitable applicators. In such a configuration, the rear opening 28 can be closed or otherwise sealed so that the grout can accumulate within the body 20 between the guide walls 24 and the back wall 22.

Returning to FIG. 1, a method for applying the flowable material 12 to the floor surface 14 is also disclosed. The method includes providing the flowable material 12 to the body 20 of the floor trowel 10.

The method also includes displacing the body 20 on the floor surface 14 to guide the flowable material 12 through the rear opening 28. The displacement of the body 20 may include engaging a second blade with the flowable material 12 to apply a primer of the flowable material to the floor surface 14 before the flowable material 12 exits the opening 28, such as with the second blade discussed above. The displacement of the body 20 may also include pushing the trowel 10 from behind. In a particular embodiment, this is performed by the user when she or he is standing on the floor surface 14 to a side of the trowel 10, and pushes it from behind. The user is therefore able to see the flowable material that was just applied, as well as where the trowel 10 will be displaced to next.

The method also includes adjusting the blade 41 of the trowel 10 so that the application edge 43 selectively engages the flowable material 12 exiting the opening 28. The blade 41 is adjustable between the first and second configurations discussed above. Adjusting the blade may include selectively tightening a connection of opposed ends 42 of the blade 41 with the body 20, such as by using the tightening mechanisms discussed above. Adjusting the blade 41 can also adjust a height of bottom application edge 43 with respect to the floor surface 14 so as to set the thickness of the layer of flowable material 12 to be applied.

In the second configuration, a method for applying the flowable material to the floor surface may include engaging the bottom application edge of the blade of the floor trowel with the flowable material exiting the opening as the body is displaced, including maintaining the orientation of the bottom application edge in alignment with the adjacent reference surface and at a constant height with respect thereto. The adjacent reference surface may be the surface of the adjacent row of tiles. The orientation of the bottom application edge varies independently of the profile of the floor surface.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A displaceable floor trowel for applying a flowable material to a floor surface, comprising:

a body for receiving the flowable material therein, the body having a back wall extending along a width of the body and two spaced apart guide walls extending forwardly from the back wall, the guide walls having lower edges abuttable against the floor surface, the back wall having a rear opening in a lower portion thereof extending along at least part of the width of the body; and a blade assembly for applying the flowable material exiting the rear opening to the floor surface upon the body being displaced thereon, the blade assembly comprising:

a blade disposed behind the back wall and extending at least along a width of the rear opening, the blade having a bottom application edge; and at least one connection member connecting the blade to the body such that the blade is moveable to selectively engage the bottom application edge with the flowable material exiting the rear opening, a connection between the at least one connection member and one of the blade and the body being configurable in first and second alternate configurations, wherein:

in the first configuration, the at least one connection member maintains the bottom application edge at a constant orientation with respect to the body, and in the second configuration, the at least one connection member allows a variation of the orientation of the bottom application edge with respect to the body.

2. The floor trowel according to claim 1, wherein the at least one connection member includes first and second pivot members spaced apart along the width of the body and pivotally connected to the body to be pivotable with respect thereto about a common pivot axis, the connection between the first and second pivot members and the blade being configurable in the first and second alternate configurations, and wherein:

in the first configuration, the first and second pivot members are both rigidly or pivotally connected to the blade and maintain the orientation of the bottom application edge constant orientation with respect to the common pivot axis, and in the second configuration, the first pivot member is connected to the blade, and the second pivot member is slidingly connected to the blade such that the blade is displaceable with respect to the second pivot members along a limited path to allow the variation of the orientation of the bottom application with respect to the common pivot axis.

3. The floor trowel according to claim 2, wherein the connection between the first pivot member and the blade is unchanged between the first and second configurations.

4. The floor trowel according to claim 2, wherein the first and second pivot members are both pivotally connected to the blade to be pivotable with respect thereto about a blade axis in the first and second configuration, the blade axis being displaceable with respect to the second pivot member along the limited path in the second configuration.

5. The floor trowel according to claim 2, wherein the second pivot member has a slot slidingly receiving therein a corresponding pin of the blade, and a tightening mechanism preventing movement of the pin of the blade within the slot when the tightening mechanism is engaged with the second pivot member, the tightening mechanism being engaged with the second pivot member in the first configuration, the tightening mechanism being at least partly disengaged from the second pivot member in the second configuration second configuration to allow slidable displacement of the pin within the slot.

6. The floor trowel according to claim 5, wherein the second pivot member includes first and second adjacent brackets interconnecting the blade and the body, the first bracket non-slidingly connected to the blade, the second bracket having the slot defined therein slidingly receiving the pin of the blade, the tightening mechanism in the first configuration rigidly interconnecting the first and second brackets, the tightening mechanism in the second configuration allowing relative movement between the first and second brackets.

7. The floor trowel according to claim 2, wherein the first and second pivot members are interconnected by a pivot shaft pivotally connected to the body rearwardly of the rear wall and defining the common pivot axis.

8. The floor trowel according to claim 2, wherein the first and second pivot members are interconnected by a pivot shaft pivotally connected to the body through the guide walls and defining the common pivot axis.

9. The floor trowel according to claim 2, wherein at least one of the pivot members comprises a biasing element engaging the blade to bias the bottom application edge towards the floor surface.

10. The floor trowel according to claim 1, further comprising a guide roller connected to one of the ends of the blade.

11. The floor trowel according to claim 10, further comprising an elongated levelling bar extending laterally away from the body from the guide roller or the blade, the levelling bar including a wheeled support mounted thereon at a distance from the body to cooperate with the guide roller to displace the levelling bar along an adjacent tile surface.

12. The floor trowel according to claim 11, wherein the wheeled support and guide rollers each have a height adjustment mechanism to adjust a height of the levelling bar and guide roller with respect to the adjacent tile surface.

13. The floor trowel according to claim 1, further comprising a handle pivotally connected to the body.

14. The floor trowel according to claim 1, further comprising a second blade having a bottom blade edge, the second blade mountable to the guide walls and disposed within the body forward of the back wall to position the bottom blade edge adjacent to the floor surface, the second blade spanning the width of the body.

15. The floor trowel according to claim 1, further comprising an intermediate guide wall extending between the body between the guide walls and parallel to at least one of the guide walls, the intermediate guide wall having a variable position along the width of the body, the intermediate guide wall having a bottom intermediate edge abuttable against the floor surface.

16. The floor trowel according to claim 1, further comprising a reservoir portion defining a receiving surface to receive the flowable material thereon, the receiving surface extending across the width of the body, the reservoir portion pivotally mounted to the body about a reservoir axis extending between a top of the guide walls, the reservoir portion pivotable into the body between a closed position wherein a rear edge of the receiving surface engages the back wall such that the cooperating back wall and receiving surface together define a receptacle to receive the flowable material, and an opened position wherein the rear edge of the receiving surface is pivoted away from the back wall to allow the flowable material to flow to the floor surface.

17. The floor trowel according to claim 1, wherein the lower edges of the guide walls each have a non-metallic covering extending therealong and abuttable against the floor surface.

18. The floor trowel according to claim 1, wherein the bottom application edge of the blade has a plurality of teeth therein.

19. A method for applying a flowable material to a floor surface with a displaceable floor trowel, comprising:

providing the flowable material to a body of the floor trowel;

displacing the body on the floor surface to guide the flowable material through an opening in a rear of the body; and engaging a bottom application edge of a blade of the floor trowel with the flowable material exiting the opening as the body is displaced, including maintaining an orientation of the bottom application edge in alignment with an adjacent reference surface and at a constant height with respect thereto, the orientation of the bottom application edge varying independently of a profile of the floor surface;

wherein maintaining the orientation of the bottom application edge in alignment with the adjacent reference surface includes engaging a levelling arm rigidly connected to the blade with the reference surface in two locations spaced apart along a direction transverse to a displacement direction of the body.

20. The method according to claim 19, further comprising biasing the bottom application edge of the blade towards the floor surface.

21. The method according to claim 19, wherein displacing the body comprises engaging a second blade with the flowable material to apply a primer of the flowable material to the floor surface prior to the flowable material exiting the opening.

22. The method according to claim 19, wherein displacing the body comprises pushing the floor trowel from behind.

23. The method according to claim 19, further comprising adjusting a width of the body of the floor trowel.

24. The method according to claim 19, further comprising closing the opening in the rear of the body to allow the flowable material to accumulate therein.

25. A method for applying a flowable material to a floor surface with a displaceable floor trowel, comprising:

providing the flowable material to a body of the floor trowel;

displacing the body on the floor surface to guide the flowable material through an opening in a rear of the body; and engaging a bottom application edge of a blade of the floor trowel with the flowable material exiting the opening as the body is displaced, including maintaining an orientation of the bottom application edge in alignment with an adjacent reference surface and at a constant height with respect thereto, the orientation of the bottom application edge varying independently of a profile of the floor surface;

wherein displacing the body comprises engaging a second blade with the flowable material to apply a primer of the flowable material to the floor surface prior to the flowable material exiting the opening.

* * * * *